US009403079B2

(12) United States Patent
Tolentino

(10) Patent No.: US 9,403,079 B2
(45) Date of Patent: Aug. 2, 2016

(54) REFORMABLE DENTAL GUARD WITH REINFORCING WIRE

(71) Applicant: Elmer Tolentino, Corona, CA (US)

(72) Inventor: Elmer Tolentino, Corona, CA (US)

( * ) Notice: Subject to any disclaimer, the term of this patent is extended or adjusted under 35 U.S.C. 154(b) by 76 days.

(21) Appl. No.: 14/078,432

(22) Filed: Nov. 12, 2013

(65) Prior Publication Data

US 2015/0040919 A1 Feb. 12, 2015

Related U.S. Application Data

(60) Provisional application No. 61/865,051, filed on Aug. 12, 2013.

(51) Int. Cl.
*A63B 71/08* (2006.01)

(52) U.S. Cl.
CPC ..... *A63B 71/085* (2013.01)

(58) Field of Classification Search
CPC .... A61F 5/566; A63B 71/085; A63B 71/086; A63B 71/088; A61C 9/0006; A61C 5/14; A61C 7/08
See application file for complete search history.

(56) References Cited

U.S. PATENT DOCUMENTS 4,544,357 A 10/1985 Williams
4,738,259 A 4/1988 Brown
4,979,516 A 12/1990 Abraham
5,879,155 A * 3/1999 Kittelsen ..... A63B 71/085 128/861
D434,501 S 11/2000 Redhage
D452,011 S 12/2001 Redhage
D473,976 S 4/2003 Wilkens
6,691,710 B2 2/2004 Kittelsen et al.
6,837,246 B1 1/2005 DeLuke
D502,787 S 3/2005 Liu
6,886,567 B1 5/2005 Liu
D523,994 S 6/2006 Manzo
D548,402 S 8/2007 Trodick
D570,549 S 6/2008 Essig
D584,002 S 12/2008 Essig
D623,357 S 9/2010 Manzo
D625,470 S 10/2010 Willems
D627,107 S 11/2010 Manzo
D630,382 S 1/2011 Manzo
7,882,839 B2 2/2011 Ambis, Jr.
D634,480 S 3/2011 Manzo
D649,252 S 11/2011 Spainhower
8,100,131 B2 1/2012 Swann et al.
D657,916 S 4/2012 Pelerin
D675,323 S 1/2013 Spainhower
D675,324 S 1/2013 Spainhower
8,539,955 B2 9/2013 Foster (Continued)

*Primary Examiner* — Kari Petrik
(74) *Attorney, Agent, or Firm* — Kirk A. Buhler; Buhler & Associates

(57) ABSTRACT

Improvements in cushioned custom dental guard to be constructed with EVA instead of Polyshok. The molding process ensures that the mouth guard provides even fit on all of the teeth. The custom fit is performed by taking an impression of the upper teeth and gums of the user. The dental guard can then be constructed to ensure a proper custom fit. Each layer provides a different function to provide an ideal cushion, as well as integration of artwork that is visible through the front of the dental guard. The dental guard may include air cells or chambers. The air cells provide a cushion by compressing the air cells to absorb an impact and spread the force of the impact over a greater area. A reinforcing wire maintains the shape and distribute impact forces. The reinforcing wire is completely embedded and encapsulated within the dental guard.

10 Claims, 7 Drawing Sheets

(56) References Cited

U.S. PATENT DOCUMENTS

2006/0237020 A1* 10/2006 Morgan ..... A63B 71/085
128/862
2009/0036889 A1* 2/2009 Callender ..... A61F 5/566
606/55
2009/0165805 A1 7/2009 Syrop et al.
2011/0171592 A1* 7/2011 Wittbold ..... A61F 5/566
433/37
2011/0209714 A1* 9/2011 Makkar ..... A63B 71/085
128/861
2011/0247635 A1 10/2011 Jansheski
2012/0260924 A1 10/2012 Foster

* cited by examiner

REFORMABLE DENTAL GUARD WITH REINFORCING WIRE

CROSS REFERENCE TO RELATED APPLICATIONS

This application is a continuation-in-part of applicant's provisional application Ser. No. 61/865,051 filed Aug. 12, 2013 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a dental guard. More particularly, the present reformable dental guard is built-up as a layering process to provide cushioning from impacts that can occur while participating in contact sports.

Description of Related Art including information disclosed under 37 CFR 1.97 and 1.98.

Athletes that participate in contact sports, for example football players, boxers and basketball players, are exposed to trauma from facial blows which may cause damage to the individual. Head blows cause motion between the upper and lower jaw that can result in trauma. To reduce the hazards of such facial trauma injuries, protective mouth guards have been developed for use by athletes and others. Protective mouth guards for athletes generally fall into three types.

All the retail boil and bite mouth guards in the market today are machine made injected molded. Because of this fact, material limitations prevent individuals to achieve a truly secure fitted mouth guard from any boil and bite.

There is no dispute that wearing a mouth guard is better than not wearing one. A properly fitted mouth guard gives the best protection that an individual can have. Wearing a custom mouth guard moves the jaw downward and forward creates joint space in the TMJ. Regardless of any technology patents filed, this cushioned space may reduce concussive forces to the temporal area.

The 3 different types of materials used today to manufacture mouth guards are EVA (ethylene vinyl acetate), Polyshok and ProForm. These materials have been vaguely studied over the years and the conclusion has become very debatable as to what is the best material. To date there has been no conclusive data that suggests which material has a higher impact rating.

The major issue is that no one except Polyshok has done any type of testing. There are two different studies that are published and both have 3 of the same authors. The problem with the studies is that they have the opposite conclusion. The first study states that Polyshok has a superior impact energy absorption rate while the second study states that there is no real difference between EVA, Polyshok, and Proform mouth guard materials. Both studies where performed in the same manner at two different times.

Problems with using Polyshok material include but are not limited to the Polyshok material quickly breaking down where the longevity of the mouth guard is significantly decreased by half. The cost of the material is triple the amount of EVA material. Polyshok material still requires the use of clear EVA as the final layer as well as the primary layer because PolyShok does not have a clear material. Polyshok cannot be a single layer material because it will not last if it is either used as the primary layer or the final layer. This also means that any testing that was conducted is not conclusive because once you place another layer on top of Polyshok you have changed the impact absorption properties.

There has been a history of bonding problems between EVA and PolyShok on the last layer where the main issue has been delamination of the two materials.

A number of patents and or publications have been made to address custom molded mouth guards. Examples of patents and or publication that disclose fabrication of custom molded mouth guards include U.S. Pat. No. 7,882,839 that issued on Feb. 8, 2011 to Edward J. Ambis Jr. that improves the ability of the wearer to speak.

U.S. Pat. No. 6,837,246 issued on Jan. 4, 2005 to Anthony G. DeLike discloses a mouth guard with an improved tongue-airway passage to improve the ability of the wearer to breath. The construction of this device is homogeneous and is fabricated from a casting of the wearer's oral cavity.

U.S. Pat. No. 6,691,710 issued on Feb. 17, 2004 to Jon D. Kittelsen et al for a composite mouth guard. The composite mouth guard is constructed from mechanically interlocking pieces. Because some of the composite materials are rigid the mouth guards are made in a variety of finite sizes to fit different size mouths. The fit is not custom made to fit an individual mouth.

U.S. Pat. No. 5,879,155 issued on Mar. 9, 1999 to Jon D. Kittelsen discloses an Adjustable Customized Composite Dental Appliance With Wire Band. The wire band connects two separate posterior pads. The wire band simply maintains the position of the two separate posterior pads to prevent the pads from being swallowed. The wire band is not covered and does not provide structural support to the dental appliance.

What is needed is a dental guard that is custom fabricated to fit the upper teeth of a user with a reinforcing wire to maintain the shape and distribute impact forces. The mouth guard is fabricated using multiple cushioning layers to provide a custom fit of optimal cushioning and improved jaw alignment. The proposed document provides disclosure of such a mouth guard.

BRIEF SUMMARY OF THE INVENTION

It is an object of the reformable dental guard to be constructed with EVA instead of Polyshok. EVA is the industry standard when manufacturing mouth guards and it is a material that has not changed over the past 10 years. EVA material is an unchanging material whether it is heated or boiled, the properties and protection stay the same. When you use the same material throughout the manufacturing process you ensure that delamination rarely occurs It is an object of the reformable dental guard for the dental guard to be molded for each individual user. The molding process ensures that the mouth guard provides even fit on all of the teeth. The custom fit is performed by taking an impression of the upper teeth and gums of the user. The dental guard can then be constructed to ensure a proper custom fit.

It is another object reformable dental guard to be constructed with layers of material. Each layer provides a different function to provide an ideal cushion, as well as integration of artwork that is visible through the front of the dental guard.

It is another object reformable dental guard to provide air cells or chambers within the dental guard. The air cells provide a cushion by compressing the air cells to absorb an impact and spread the force of the impact over a greater area.

It is another object reformable dental guard to provide a method of manufacturing a boil and bite mouth guard that can be re-boiled and reshaped to fit a subsequent mouth guard to achieve a fit characteristic that of a custom fitted mouth guard. In order to achieve the closest possible fit to a custom mouth guard, you have to manufacture the boil and bite with the dimensions, average surface area, and thickness comparable to that of a custom mouth guard. This will be the design guideline for the mold for which the boil and bite will be used to manufacture.

It is another object reformable dental guard to be created similar to a custom mouth guard where an important step deals with the materials used to manufacture custom mouth guards, when melting point is reached it can conform to dental anatomy and during the cool down process, holds its shape more steady than that of injected molded plastic. No boil and bite manufacturer has ever attempted this manufacturing process due to the intensive process and manual labor it takes to make a custom mouth guard.

It is another object reformable dental guard to utilize a reinforcing wire to maintain the shape and distribute impact forces. The reinforcing wire is spline or sine shaped to protect the distal tips of the front teeth and anchor along the sides of the molars to provide additional protection to the teeth and provide structural shape to the dental guard.

It is still another object of the reformable dental guard for the dental guard to accept a standard or custom logo. The logo is embedded into the front of the dental guard such that the artwork can be visible through to opponents.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
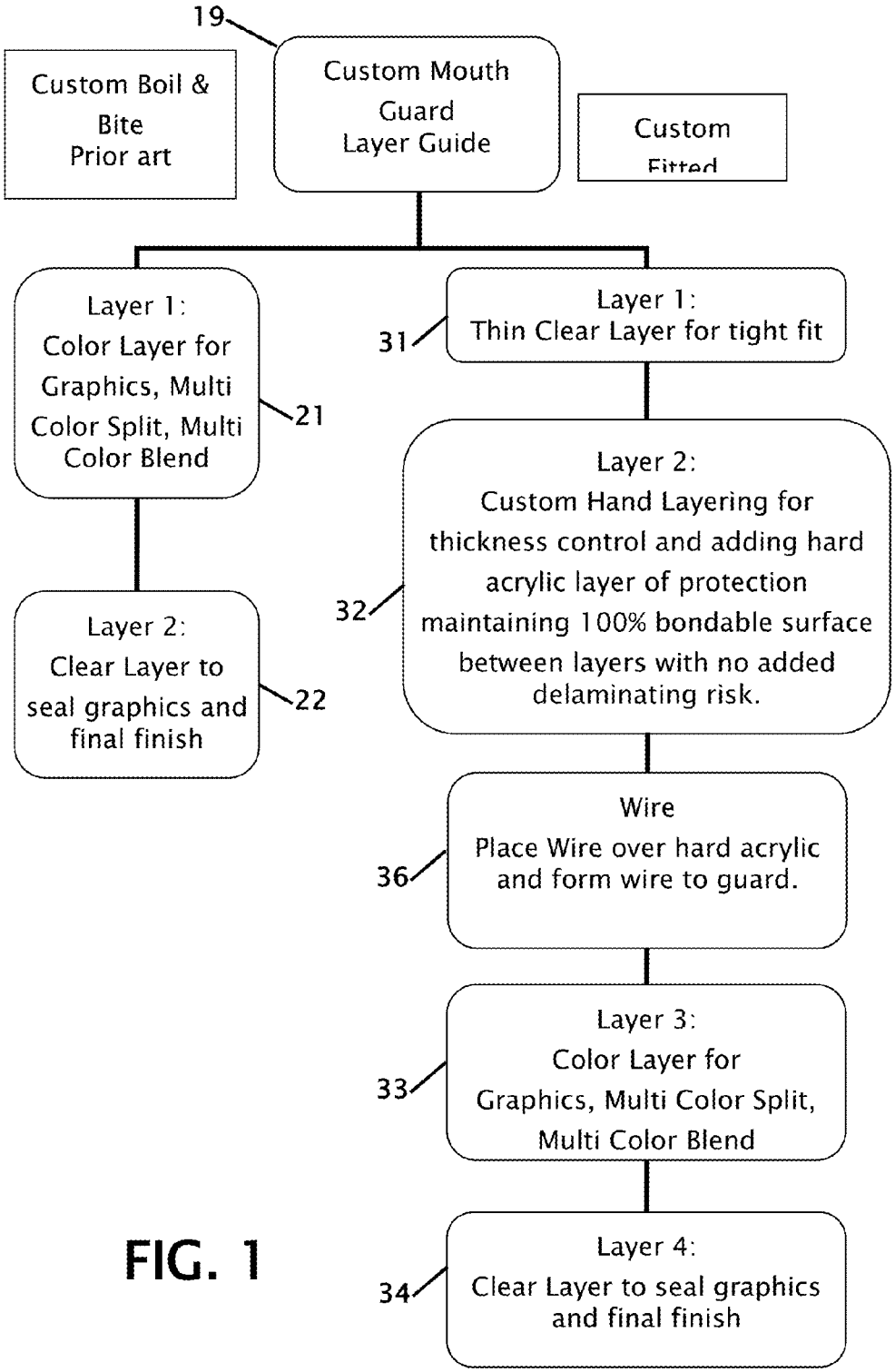
FIG. 1 shows a comparison of the construction of the reformable mouth guard with other manufacturing processes.

FIG. 1 shows a comparison 19 of the construction of the dental guard with other prior art manufacturing processes. The diagrams that are located and referenced throughout this section to help you gain a broader understanding of how the dental custom dental guard differs from boil and bite mouth guard manufacturing companies.

Many companies start with 4 mm material 21 which does not suck into the interproximal contacts very well which in turn can cause a loose fit. Other companies will typically use a use a second layer that is 2 mm or 3 mm thick material 22 which creates bulky mouth guard on the palate of the athlete. At this point, prior art mouth guards put graphics on top of the already approximately 8 mm thick material of material which reduces down to approximately 4-5 mm of thickness. The prior art makes every dental guard in essentially the exact same way and using the exact same material no matter what size mouth of the user.

With custom dental guards, after a dental impression has been obtained a thin clear layer of material is used as a base material 31 of between 1 mm and 2 mm. A second layer 32 is combined to the first layer. The second layer is custom hand layering for thickness control and adding hard layer of protection maintaining 100% bondable surface between layers with no added delaminating risk. Within this layer air pockets or cushions can be included for shock dispersion when applicable or desired. The second layer 32 is then heat treated until it is completely smooth and uniform.

A wire 36 is placed over the hard acrylic and the wire is formed to the guard. Third Layer 33 is either 2 mm or 3 mm material. This sub assembly of layers has not yet been added to the palate area. The thickness of the material that is used is based on the width of the palatal area of each unique user. The fourth or last layer 34 is clear either 2 mm or 1.5 mm depending on the patient's mouth. The improvements are not only with the graphic quality, but also with the manufacturing process.

Figure 2:
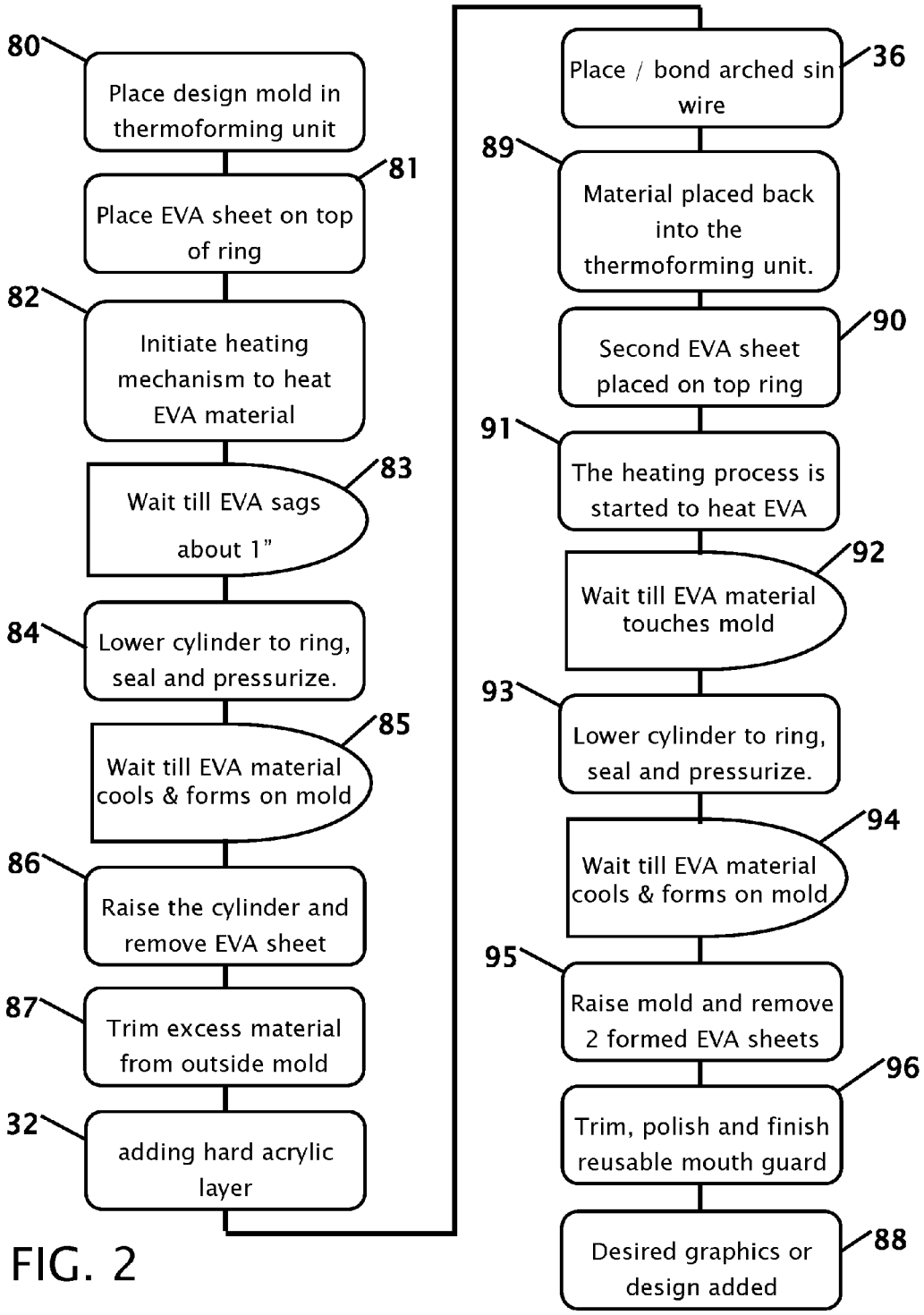
FIG. 2 shows a flow chart of the manufacturing process used to create the reformable dental guard.

FIG. 2 shows a flow chart of the manufacturing process used to create the reformable dental guard. First the design mold is placed in the thermoforming unit 80. An EVA sheet is placed on top of the ring 81. The heating mechanism is initiated to heat the EVA material 82.

Once the EVA material sags to approximately 1" 83 the thermoforming cylinder is lowered 84 to the ring to seal and pressurize the chamber between 70 to 90 psi. When the cooling process is complete, the EVA material is formed on the mold 85. When cool down process is complete, raise the cylinder and remove EVA sheet from mold 86. Excess material that forms on the outside of the design mold is cut and trimmed off of the mold 87. A hard adrylic layer 32 is added.

The arched sine wire 36 is the placed onto the mouth guard where a hard acrylic layer 35 is added to the guard to bond and retain the arched sine wire. The acrylic layer also increases the structural strength of the mouth guard over the front anterior teeth.

The material is placed back on the mold and the mold is placed back into the thermoforming unit 89.

A second EVA sheet is placed on top of the ring 90. The heating process is initiate with the heating mechanism to heat the second sheet of EVA material 91. Once the material sags to touch mold 92, initiate the thermoforming cylinder to lower towards the ring 93 to seal and pressurize the chamber between 70-90 psi. When cool down process is complete 94, raise the cylinder and remove the 2 layers of formed EVA sheet from the mold 95. Any desired graphics or artwork is applied to the mouth guard surface where it is the desired location 88. For some complex graphics additional layers of EVA may be required between different graphic images.

Cut and trim the excess material that formed outside of the design mold 96. Polish the edges so that there are no excess and the edges are rounded and curved. Cutting, trimming, and polishing skillsets are learned in the custom mouth guard arena. Because of the construction of the reusable mouth guard, if the fit is not correct, the mouth guard can be re-boiled and the material will essentially re-flow and allow a person, or a subsequent person to boil and bite the mouth guard to achieve a custom fit mouth guard. The re-heating and bite operation can be repeated numerous times with little or no degradation or compromise in the custom fit.

To form the reformable dental guard in the mouth of a user reformable dental guard is heated in water between 180 and 212 degrees Fahrenheit and then placed into a mouth on upper teeth of a person whereupon the person closes said mouth and forces said upper teeth into the reformable dental guard for create an initial impression into the reformable dental guard. If the user wants to re-form the dental guard or another user want to use the same dental guard the reformable dental guard is again re-boiled where the dental guard will reflow into its original condition where it can conform into the mouth of the user.

Figure 3:
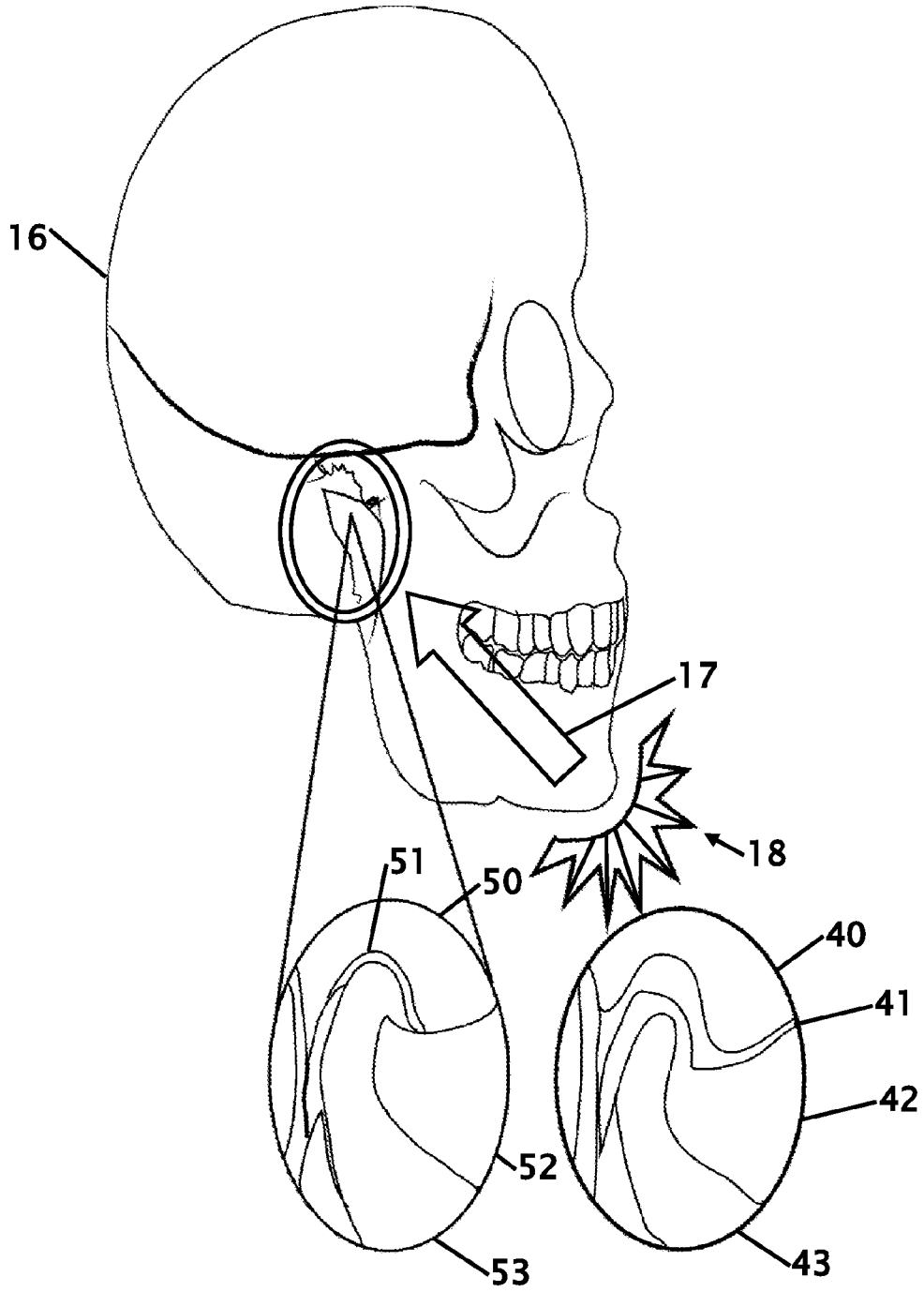
FIG. 3 shows a pictorial view of what occurs when a jaw is struck.
Figure 4:
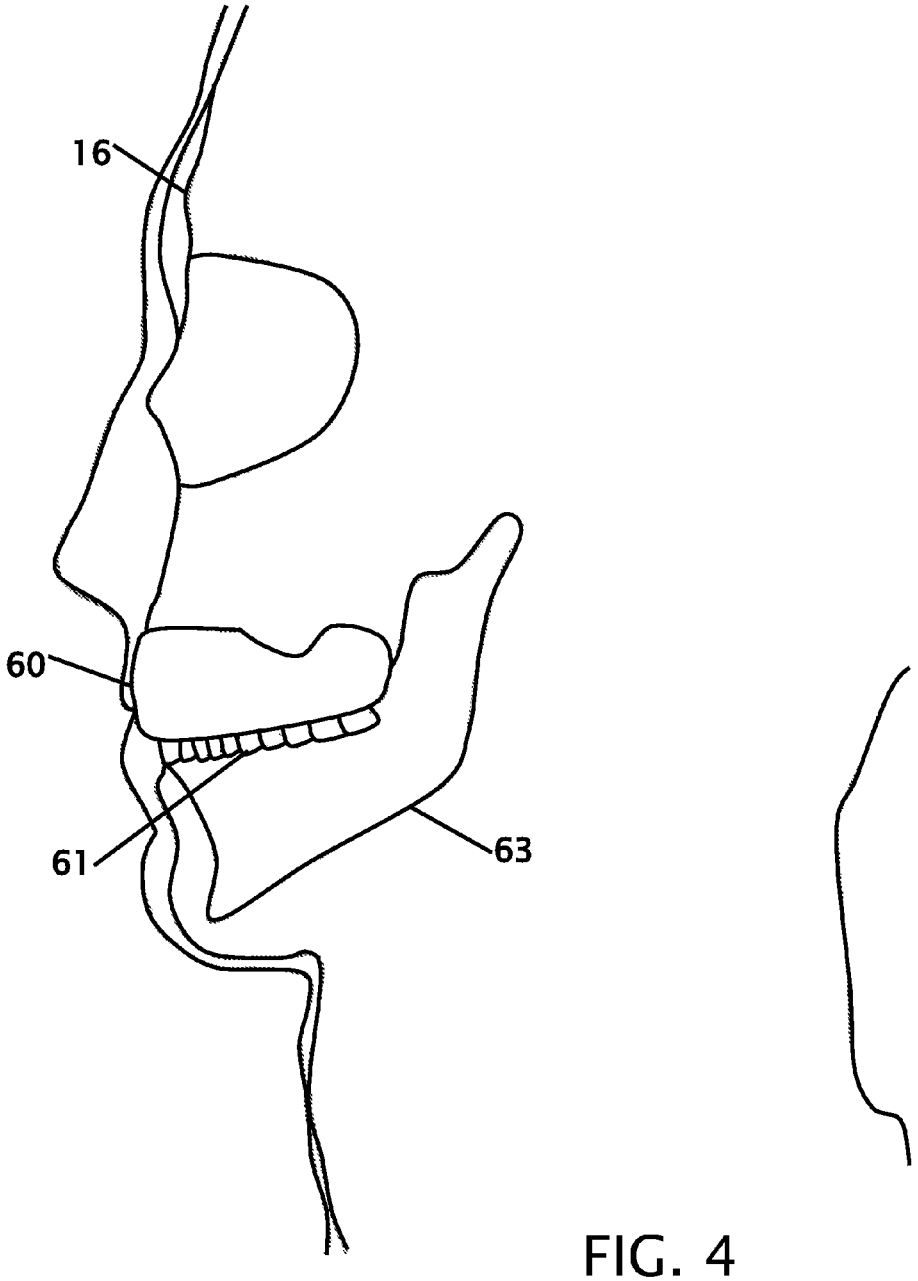
FIG. 4 shows a partial cross section of the reformable mouth guard in a user.

FIG. 3 shows a pictorial view of what occurs when a jaw is struck, and FIG. 4 shows a partial cross section of the dental guard in a user. In normal resting mode the mandible 43 is cushioned by the connective tissue 42 to the condyle 41 at the end of the jaw in the socket 40. When an unprotected athlete receives an impact 18 to the lower jaw or chin. The impact is translated 17 through the jaw or mandible 43 and can cause an impact that can hit the brain thereby causing a concussion.

The concussion is the result of the mandible 53 being pushed so hard that the connective tissue 52 is squeezed into the condyle 51 and into the socket 50. From FIG. 3 the mandible 63 is cushioned by the reformable dental guard 60 that cushions the athletes 16 teeth 61 to increase the frictional forces between the teeth to reduce movement of the mandible 63.

Figure 5:
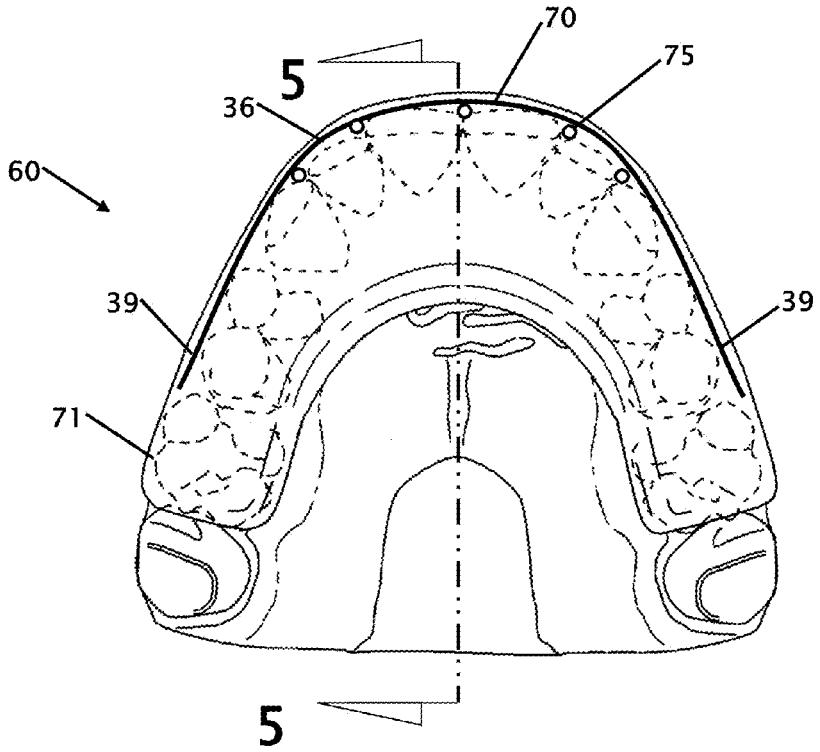
FIG. 5 shows a bottom view of the reformable mouth guard on the upper pallet.

FIG. 5 shows a bottom view of another embodiment of the reformable dental guard 60 on the upper pallet. From FIG. 4 the dental guard is formed from the anterior teeth (incisors and canines) 70 to the posterior teeth (molars and bicuspids) 71. Optional air cushions 75 are shown placed between adjacent incisors and canines. In this embodiment seven air cushions are shown, but more or less air cushions 75 are contemplated. Locating the air cushions 75 between the teeth is generally placed because extra space exists between the teeth without increasing the thickness of the dental guard. Placement of the cushion(s) 75 is generally not made between posterior teeth 71 because impacts to this area of the mouth are less common. The wire 36 is shown wrapping from the front teeth with the wire 36 terminating 39 at the posterior teeth 71.

Figure 6:
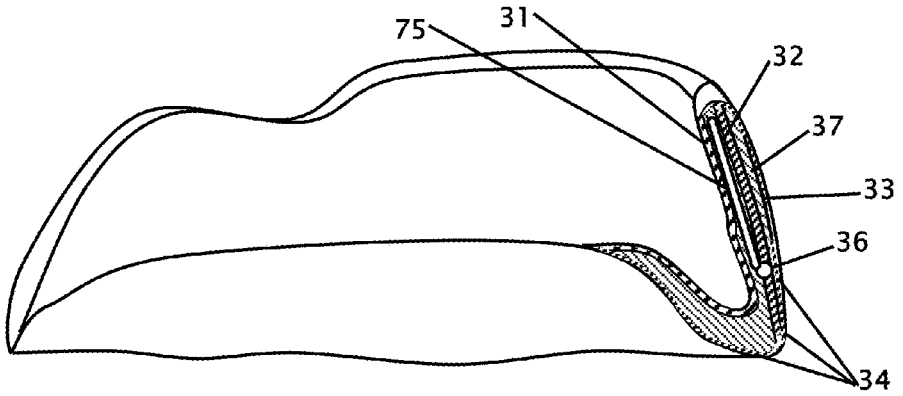
FIG. 6 shows a cross sectional view of the reformable mouth guard from FIG. 5.

FIG. 6 shows a cross sectional view of the dental guard from FIG. 5. A thin clear layer of material is used as a base material 31. A second layer 32 is combined to the first layer. The second layer is custom hand layering for thickness control and adding hard layer of protection maintaining 100% bondable surface between layers with no added delaminating risk. Within this layer air pockets or cushions 75 can be included for shock dispersion when applicable or desired. The second layer 32 is then heat treated until it is completely smooth and uniform. Third Layer 33 is either 2 mm or 3 mm material. The EVA layer 37 is also shown in this figure. This sub assembly of layers has not yet been added to the palate area. The thickness of the material that is used is based on the width of the palatal area of each unique user. The fourth or last layer 34 is clear either 2 mm or 1.5 mm depending on the patient's mouth.

Controlling the thickness of the dental guard is critical to providing comfort and protection. There has been limited published articles on testing that has been performed on mouth guards after a mouth guard has been manufactured. Even the surface area being tested only gives the best representation of the type of impact and simulation as an estimate to the protection.

Figure 7A:
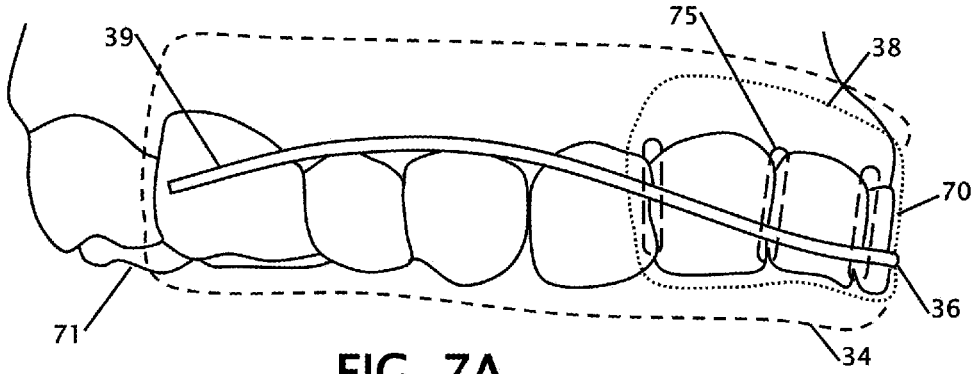
FIG. 7A, FIG. 7B and FIG. 7C show the shape and position of the hard acrylic and the reinforcing wire in the reusable mouth guard.
Figure 7B:
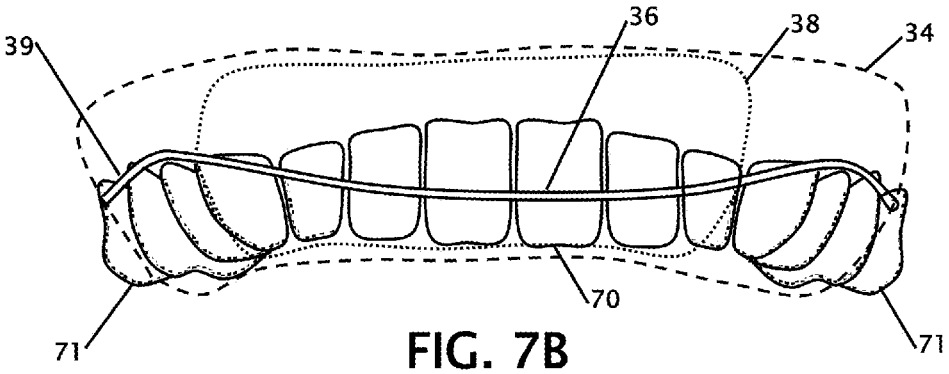
Figure 7C:
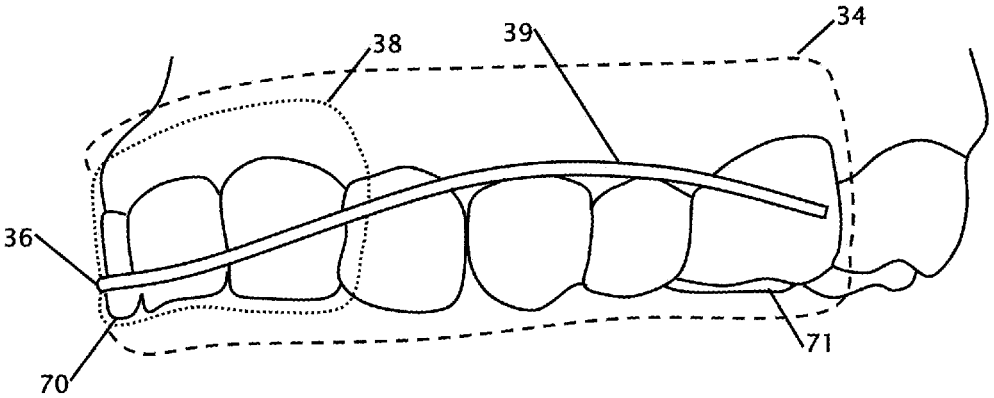

FIG. 7A, FIG. 7B and FIG. 7C show the shape and position of the hard acrylic 38 and the reinforcing wire 39 in the reusable mouth guard. The dental guard is formed from the anterior teeth (incisors and canines) 70 to the posterior teeth (molars and bicuspids) 71. Optional air cushions 75 are shown placed between adjacent incisors and canines. The reinforcing wire 36 is formed in as a spline or sine wave. The wire 36 is shown wrapping from the front teeth with the wire 36 terminating 39 at the posterior teeth 71. The reinforcing wire 36 maintains the shape and distribute impact forces. The reinforcing wire is completely embedded and encapsulated within the dental guard. Additional location of the hard acrylic can be placed along the length of the wire and at the ends of the wire depending upon the nature of the sport, user teeth grinding and other factors.

The reinforcing wire 39 is spline or sine shaped to protect the distal tips of the anterior teeth (incisors and canines) 70 and arches to the posterior teeth (molars and bicuspids) 71 to provide additional protection to the teeth and provide structural shape to the dental guard. At the sides of the dental guard the reinforcing wire arches near the gum line to increase the vertical displacement of the wire to improve retention of the reinforcing wire within the dental guard to reduce a potential of the wire from being "stripped" from the dental guard. It is also contemplated that the reinforcing wire can be knurled or otherwise surface treated to increase retention of the reinforcing wire 39 within the dental guard.

Figure 8B:
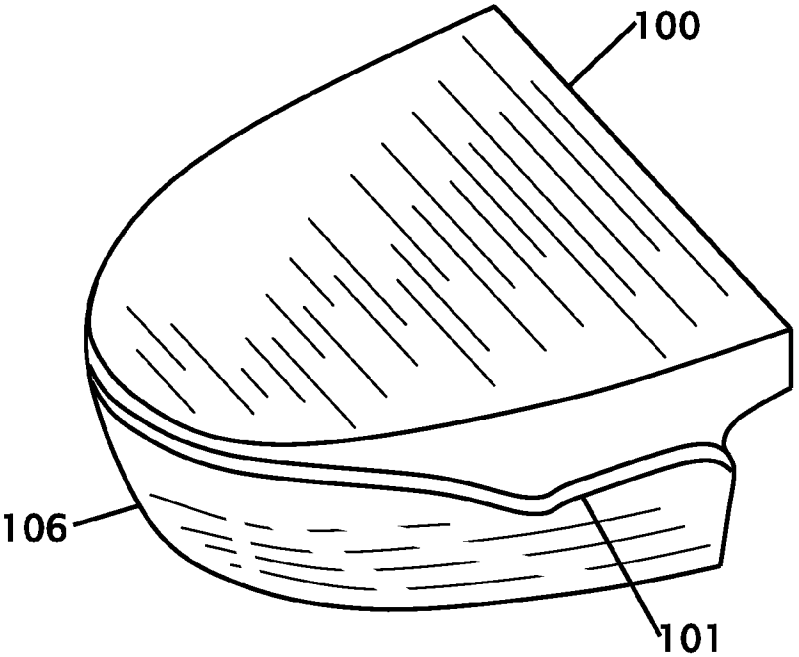
FIG. 8A and FIG. 8B shows an image of the mold that is used to form the reusable mouth guard.
Figure 8A:
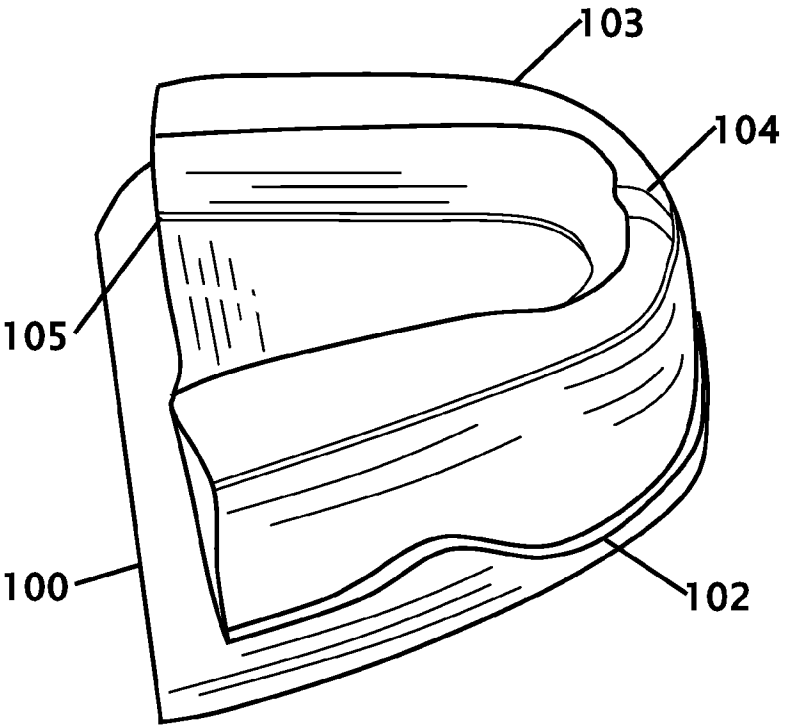

FIG. 8A shows an inside perspective view of the mold used to make the reformable dental guard, and FIG. 8B shows a bottom perspective view of the reformable dental guard. The bottom 100 of the mold is where the mold sits flat within the thermoforming unit. The sheets of EVA material are placed on the top surface of the mold as might be seen in FIG. 7A. From this top perspective view 7A the mold has a raised outer ridge 103 that forms the general profile where teeth would exist in the mouth of the athlete. A lowered area 104 in the front of the mold provides some clearance between the front teeth. A clearance area 105 in the center of the mold provides clearance for the tongue of the athlete. A ridge 101 and 102 forms the trim area for the gums of an athlete. The vertical wall 106 provides a clearance for the teeth of an athlete.

Thus, specific embodiments of a cushioned reformable dental guard have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A reformable dental guard comprising:

a first ethylene vinyl acetate (EVA) layer having a first side that is adapted to an upper teeth pattern from opposing anterior molars to incisors and canines;

said first EVA layer is adapted to be trimmed to envelope said upper teeth pattern;

a hard acrylic layer having a first side on a second side of said first EVA layer, said hard acrylic layer being smaller than said first EVA layer and adapted to not cover said opposing anterior molars;

a reinforcing wire terminating near a middle of said opposing anterior molars, said reinforcing wire placed onto a second side of said hard acrylic layer;

said reinforcing wire passing at a middle of its span to a location that is adapted to be in a middle of said upper teeth pattern of said incisors and said canines;

a second EVA layer over said first EVA layer;

said second EVA layer covers all of the second side of said hard acrylic layer, said second side of said first EVA layer, and said reinforcing wire; and further including a plurality of enclosed air cells between said second side of said first EVA layer and said reinforcing wire, said hard acrylic layer and a first side of said second EVA layer, wherein said enclosed air cells are adapted for locations between adjacent teeth in said upper teeth pattern.

2. The reformable dental guard according to claim 1 wherein said reinforcing wire has a first free end that is adapted to start in mid proximity to a first side of mid upper posterior teeth, then arches in proximity to distal tips of anterior teeth, then arches to a second end in proximity to an opposing side of posterior teeth and is adapted to be completely encapsulated between said first EVA layer and said second EVA layer.

3. The reformable dental guard according to claim 1 wherein said reinforcing wire is adapted to be completely embedded and encapsulated within said dental guard.

4. The reformable dental guard according to claim 1 wherein said reinforcing wire is adapted to be surface treated along its entire length to increase retention of said reinforcing wire within said reformable dental guard.

5. The reformable dental guard according to claim 1 wherein said first EVA layer is between 1 and 3 mm in thickness.

6. The reformable dental guard according to claim 1 wherein said second EVA layer is between 2 and 5 mm in thickness.

7. The reformable dental guard according to claim 1 that further includes a third layer having a first side that is adapted to be formed over a second side of said second EVA layer.

8. The reformable dental guard according to claim 7 wherein said third layer is selected from a group consisting of graphics, multi-color split and multi-color blend.

9. The reformable dental guard according to claim 8 that further includes a fourth layer having a first side that is adapted to be formed over a second side of said third layer.

10. The reformable dental guard according to claim 9 wherein said fourth layer is clear and covers said second side of said third layer.

* * * * *